US012007172B2

(12) United States Patent
Wang et al.

(10) Patent No.: US 12,007,172 B2
(45) Date of Patent: Jun. 11, 2024

(54) HEAT SINK

(71) Applicants: YI CHANG CO., LTD., New Taipei (TW); Po-Shen Wang, New Taipei (TW); Hsin-Tzu Kuo, New Taipei (TW)

(72) Inventors: Po-Shen Wang, New Taipei (TW); Hsin-Tzu Kuo, New Taipei (TW)

(73) Assignee: YI CHANG CO., LTD., New Taipei (TW)

( * ) Notice: Subject to any disclaimer, the term of this patent is extended or adjusted under 35 U.S.C. 154(b) by 82 days.

(21) Appl. No.: 17/573,660

(22) Filed: Jan. 12, 2022

(65) Prior Publication Data

US 2022/0228812 A1 Jul. 21, 2022

(30) Foreign Application Priority Data

Jan. 20, 2021 (TW) ..... 110102154

(51) Int. Cl.
*F28D 15/04* (2006.01)

(52) U.S. Cl.
CPC ..... *F28D 15/046* (2013.01)

(58) Field of Classification Search
CPC ..... F28D 15/04; F28D 15/046
USPC ..... 165/104.26
See application file for complete search history.

(56) References Cited

U.S. PATENT DOCUMENTS 4,651,808 A * 3/1987 Mizuno ..... F02G 1/057 165/4
2007/0163755 A1* 7/2007 Kim ..... H01L 23/427 165/104.21
2010/0157535 A1 6/2010 Oniki et al.
2010/0254090 A1* 10/2010 Trautman ..... H05K 7/20336 29/890.032
2010/0307722 A1* 12/2010 Ryoson ..... F28D 15/046 228/265
2021/0071963 A1* 3/2021 Hulse ..... F28D 15/046
2021/0293488 A1* 9/2021 Lewis ..... F28D 15/046

FOREIGN PATENT DOCUMENTS

CN 107764116 A 3/2018
CN 110779370 A 2/2020
TW M464634 U 11/2013

* cited by examiner

*Primary Examiner* — Tho V Duong
(74) *Attorney, Agent, or Firm* — WPAT, P.C

(57) ABSTRACT

A heat sink includes a casing and a capillary structure. The casing includes a chamber filled with a working fluid. The capillary structure is located in the chamber. The capillary structure includes a plurality of capillary pores of different diameters. The capillary structure includes at least one supporting portion connected to a substrate. The substrate and the at least one supporting portion abut two opposite inner faces of the casing, respectively.

13 Claims, 13 Drawing Sheets

HEAT SINK

CROSS REFERENCE TO RELATED APPLICATION

The application claims the benefit of Taiwan application serial No. 110102154, filed on Jan. 20, 2021, and the entire contents of which are incorporated herein by reference.

BACKGROUND OF THE INVENTION

1. Field of the Invention

The present invention relates to a heat sink and, more particularly, to a heat sink for cooling an electronic element.

2. Description of the Related Art

With the progress of electronic technology and continuous development of semiconductor industry technology in high performance, high power, and miniaturization, the heat and concentration during operation of IC elements increase. Thus, it is an inevitable issue in increasing the cooling effect of electronic products. Currently, there are various heat sinks available on the market and applicable on electronic products. In comparison with conventional fins, a vapor chamber or a heat pipe, which uses a working fluid and a capillary structure, can provide cooling by gas-liquid phase change of the working fluid, thereby reducing the concentration phenomenon of hot spots while providing advantages of quick reaction time, good temperature uniformity, light weight, and good efficiency. There are currently three common capillary structure types: grooves, meshes, and sintering.

In the above conventional heat sink with a working fluid and a capillary structure, since the working fluid and the capillary structure are disposed in a chamber in the heat sink, a plurality of posts is required in the chamber in addition to the working fluid and the capillary structure to avoid collapse or deformation of the surface of the chamber due to a normal pressure acting on the surface of the chamber or a negative pressure resulting from an internal vacuum. In manufacture, the posts and the capillary structure are processed separately, such as placement operation of the posts, welding operation of the posts, or directly etching metal sheets to form the posts. Thus, the complicated procedures increase difficulties in manufacture, causing difficulties in reduction of the manufacturing costs and in increase of the yield. Furthermore, the posts formed by etching cannot provide the capillary action and are the critical factor of difficulties in improving the cooling effect in a limited space.

Thus, it is necessary to improve the conventional heat sinks.

SUMMARY OF THE INVENTION

To solve the above problems, an objective of the present invention is to provide a heat sink including a supporting portion providing both supporting function and capillary action, which can increase the cooling effect and reduce the volume, thereby further significantly reducing the manufacturing costs.

Another objective of the present invention is to provide a heat sink which can significantly reduce the diameters of the capillary pores of the capillary structure and can increase the number of the capillary pores, thereby achieving better cooling effect.

A further objective of the present invention is to provide a heat sink which can simply the manufacturing procedures.

When the terms "front", "rear", "left", "right", "up", "down", "top", "bottom", "inner", "outer", "side", and similar terms are used herein, it should be understood that these terms have reference only to the structure shown in the drawings as it would appear to a person viewing the drawings and are utilized only to facilitate describing the invention, rather than restricting the invention.

As used herein, the term "a", "an" or "one" for describing the number of the elements and members of the present invention is used for convenience, provides the general meaning of the scope of the present invention, and should be interpreted to include one or at least one. Furthermore, unless explicitly indicated otherwise, the concept of a single component also includes the case of plural components.

As used herein, the term "coupling", "assembly", or similar terms is used to include separation of connected members without destroying the members after connection or inseparable connection of the members after connection. A person having ordinary skill in the art would be able to select according to desired demands in the material or assembly of the members to be connected.

A heat sink according to the present invention includes a casing and a capillary structure. The casing includes a chamber filled with a working fluid. The capillary structure is located in the chamber. The capillary structure includes a plurality of capillary pores of different diameters. The capillary structure includes at least one supporting portion connected to a substrate. The substrate and the at least one supporting portion abut two opposite inner faces of the casing, respectively.

Thus, in the heat sink according to the present invention, the capillary structure forms the supporting portion. Thus, the steps of placing posts, welding the posts, or etching for forming the posts are not required. The manufacturing procedures of the heat sink can be simplified, and the manufacturing costs of the heat sink can be reduced significantly. Since the supporting portion provides both efficacies of supporting and capillary action, the cooling effect can be increased and the volume of the heat sink can be further reduced, which is very helpful in miniaturization or thinning of the heat sink.

In an example, the capillary structure may include capillary pores of a diameter smaller than 0.2 mm. Thus, the capillary action is generated.

In an example, the capillary structure may be shaped by punching or rolling to form the substrate and the at least one supporting portion which are integrally connected to each other. Thus, the diameters of the capillary pores are reduced, and the number of the capillary pores is increased.

In an example, an average diameter of capillary pores in the substrate may be smaller than an average diameter of capillary pores in the at least one supporting portion. Thus, a composite capillary force is generated.

In an example, the capillary pores in the at least one supporting portion may be larger than 0.2 mm. Thus, the steam space is increased.

In an example, the capillary structure may be formed by shaping at least one metal net. Thus, an adsorption force is provided for return flow of the working fluid.

In an example, the capillary structure may be formed by stacking a plurality of metal nets and then shaping the plurality of metal nets. Thus, the number of the capillary pores is increased.

In an example, the plurality of metal nets may have different meshes and different thicknesses. Thus, metal nets with larger-diameter wires and metal nets with smaller-diameter wires can be stacked to save material.

In an example, the plurality of metal nets may be stacked and in different angular positions relative to each other. Thus, the shape of the meshes of the capillary structure is not limited to square or rhombic obtained by conventional plain weaving, providing densely distributed capillary pores of composite shapes.

In an example, when two metal nets are stacked, metal wires of one of the two metal nets are aligned with capillary pores in another of the two metal nets, and the two metal nets are embedded into each other after shaping. Thus, the number of the capillary pores of the capillary structure is increased.

In an example, adjacent metal nets of the capillary structure may be partially embedded into each other after shaping. Thus, adjacent metal nets of the capillary structure have different meshes in the opposite direction.

In an example, the capillary structure may be formed by sintering a plurality of powder particles and then shaping the plurality of powder particles after sintering. Thus, the adsorption force for return flow of the working fluid is further increased.

In an example, the substrate may include a first board and a second board having a thickness different from a thickness of the first board. Thus, the first board and the second board may have capillary pores of different diameters to increase the flow rate of the working fluid.

In an example, the casing may include at least one recessed portion recessed towards the cavity. Thus, the at least one recessed portion can serve as an evasive portion for receiving a heat generating object or an electronic element, reducing the space occupied.

In an example, the at least one recessed portion may abut the at least one supporting portion. Thus, the cooling area and the supporting force are increased.

In an example, the at least one recessed portion and the at least one supporting portion may not abut each other. Thus, the cooperative mechanism provides an evasion to permit easy installation of the heat sink in a limited space.

In an example, the at least one recessed portion may make one of the two opposite inner faces of the casing protrude into the chamber. The capillary structure sinuates on the one of the two opposite inner faces to form the at least one supporting portion. Thus, the at least one supporting portion and the at least one recessed portion can be integrally formed to simplify the processing procedure.

In an example, the casing may include a first sheet having a receiving groove. Furthermore, the casing may include a second sheet coupled to the first sheet to form the chamber. Thus, a vapor chamber is formed.

In an example, the second sheet includes a receiving groove intercommunicating with the receiving groove of the first sheet. Thus, a larger chamber can be formed to increase the cooling effect.

In an example, the plurality of metal wires or the plurality of powder particles of the capillary structure can expand after shaping. Thus, the diameter of the capillary pores can be reduced to increase the adsorption force of the capillary action.

In an example, the plurality of metal wires of the capillary structure can become flat after shaping. Thus, the heat conduction area can be increased.

The present invention will become clearer in light of the following detailed description of illustrative embodiments of this invention described in connection with the drawings.

DETAILED DESCRIPTION OF THE INVENTION

Figure 1:
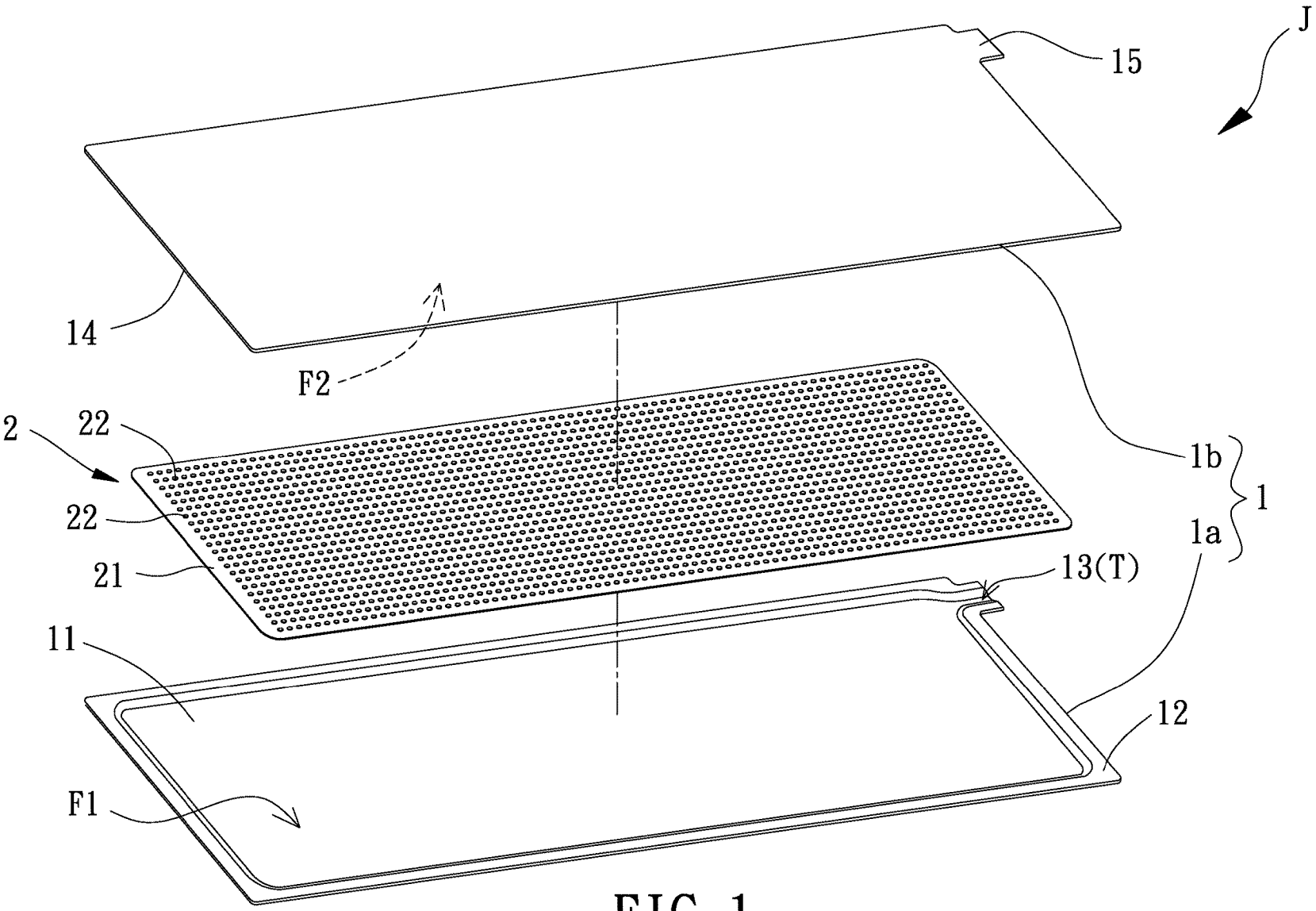
FIG. 1 is an exploded, perspective view of a heat sink of a first embodiment according to the present invention.
Figure 2:
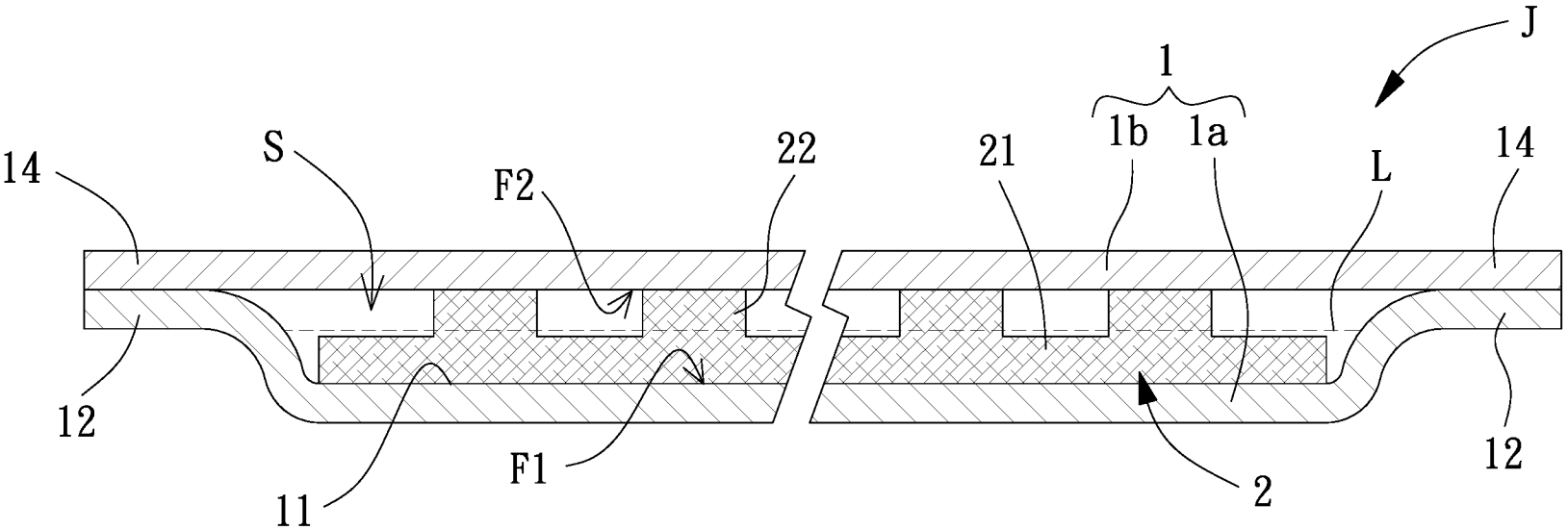
FIG. 2 is a cross sectional view of the heat sink of the first embodiment according to the present invention after assembly.

With reference to FIGS. 1 and 2, a heat sink of a first embodiment according to the present invention includes a casing 1 and a capillary structure 2. The capillary structure 2 is located in the casing 1.

The casing 1 can be made of a material with a thermally conductive function, such as copper, aluminum, titanium, or stainless steel. Thus, the casing 1 can be directly or indirectly connected to a heat generating object for cooling the heat generating object. The heat generating object can be a central processor of a mobile phone or any other electronic product, or an electronic element, such as a chip, on a circuit board, which generates heat during operation. The casing 1 includes a chamber S therein. The chamber S can be filled with a working fluid L which can be water, alcohol, or any other liquid. Preferably, the working fluid L can be an electrically non-conductive liquid, such that the working fluid L in the liquid state can easily absorb heat and evaporate into a gaseous state. Thus, the gas-liquid phase change mechanism of the working fluid L can be used to transfer the heat energy. The chamber S is in a sealed vacuum state to avoid loss of the working fluid L in the gaseous state as well as avoiding adverse affects to the cooling effect resulting from squeezing of the space for the working fluid L in the gaseous state due to occupation of air.

The configuration of the casing 1 is not limited in the present invention. The outline of the casing 1 can be adjusted according to factors, such as the type, use conditions, or installation conditions of the heat sink. For example, the heat sink of this embodiment may be a vapor chamber J. The casing 1 may include a first sheet 1*a* and a second sheet 1*b*. After coupling of the first sheet 1*a* and the second sheet 1*b*, the chamber S can be formed therein for receiving the capillary structure 2.

The first sheet 1*a* may include a receiving groove 11. The receiving groove 11 may be formed by punching, die casting, bending, etching, etc. The present invention is not limited in this regard. An annular ledge 12 may be formed along a periphery of the receiving groove 11. A passageway 13 extends through the annular ledge 12 and intercommunicates with the receiving groove 11. The second sheet 1*b* may select a material the same as or different from that of the first sheet 1*a*. The present invention is not limited in this regard. A coupling portion 14 may be formed along a periphery of the second sheet 1*b*. The coupling portion 14 can be coupled with the annular ledge 12 of the first sheet 1*a*, such that the second sheet 1*b* and the first sheet 1*a* together form the chamber S for receiving the capillary structure 2. The second sheet 1*b* further includes a passageway cover 15 connected to the coupling portion 14. The passageway cover 15 can be aligned with the passageway 13 of the first sheet 1*a* to jointly form a liquid filling passageway T. The liquid injection passageway T can be used to suck air out of the chamber S and to fill the working fluid L used by the vapor chamber J into the chamber S. The liquid filling passageway T can be sealed after filling of the working fluid L, avoiding loss of the working fluid L in the gaseous state.

Further to the above description, the way of coupling of the second sheet 1*b* and the first sheet 1*a* is not limited in the present invention. For example, the second sheet 1*b* can be coupled to the first sheet 1*a* by adhesion, embedding, threading connection, snapping, welding, etc. In this embodiment, the annular ledge 12 of the first sheet 1*a* can be coupled to the coupling portion 14 of the second sheet 1*b* by brazing or laser welding. The liquid filling passageway T can be sealed by the welding flux, such that the first sheet 1*a* and the second sheet 1*b* can be reliably coupled without generating gaps, thereby increasing the structural strength.

The capillary structure 2 is located in the chamber S. The capillary structure 2 may be a porous structure to assist in flow of the working fluid L by capillary action. The capillary structure 2 may be a porous mesh structure or sintered powder structure. The sintered powder structure can be produced from copper powders or other suitable powders subjected to a powder sintering process. The present invention is not limited in this regard.

Further to the above description, after initial formation of the capillary structure 2, at least one substrate 21 and at least one supporting portion 22 can be formed after shaping. The shaping can be punching or rolling. The present invention is not limited in this regard. In this embodiment, the supporting portion 22 is disposed on the substrate 21. The average diameter of capillary pores in the supporting portion 22 can be different from that of capillary pores in the substrate, thereby providing a composite capillary action. The diameter of the capillary pores of the supporting portion 22 may be larger than 0.2 mm to increase the vapor space. The capillary structure 2 may abut a lower inner surface F1 of the casing 1 (the surface of the first sheet 1*a* facing the second sheet 1*b*) by the substrate 21 and may abut an upper inner surface F2 of the casing 1 (the surface of the second sheet 1*b* facing the first sheet 1*a*) by the supporting portion 22. Thus, the chamber S can be supported by the supporting portion 22 and the substrate 21 to avoid collapse or deformation of the surface of the chamber S due to a normal pressure acting on the surface of the chamber S or a negative pressure resulting from an internal vacuum. Particularly, the heat sink according to the present invention does not require the steps of welding of posts and forming post holes in the capillary structure or etching for forming posts of conventional heat sinks. Thus, the manufacturing process of the heat sink according to the present invention can be simplified to effectively and significantly reduce the manufacturing costs. Furthermore, the diameter of the capillary pores can be reduced and the number of capillary pores per unit area can be increased by shaping the capillary structure 2. Thus, the effect for adsorption of the working fluid L can be increased. Namely, the flow rate of the working fluid L can be increased, thereby achieving better cooling effect.

Figure 3:
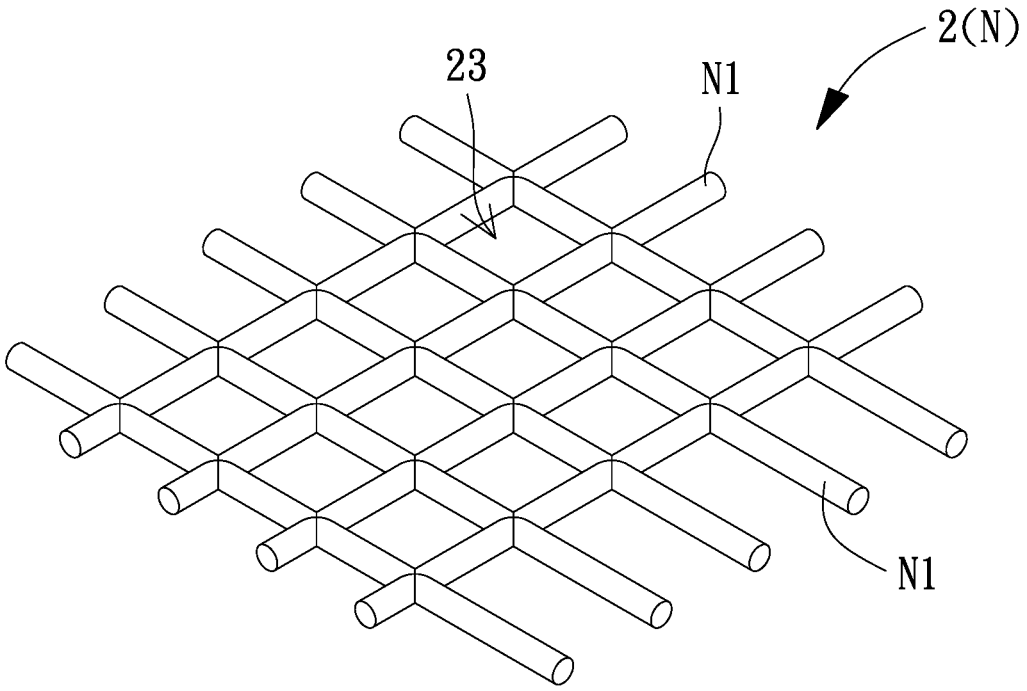
FIG. 3 is a perspective view of a capillary structure in the form of a metal net according to the present invention.
Figure 4:
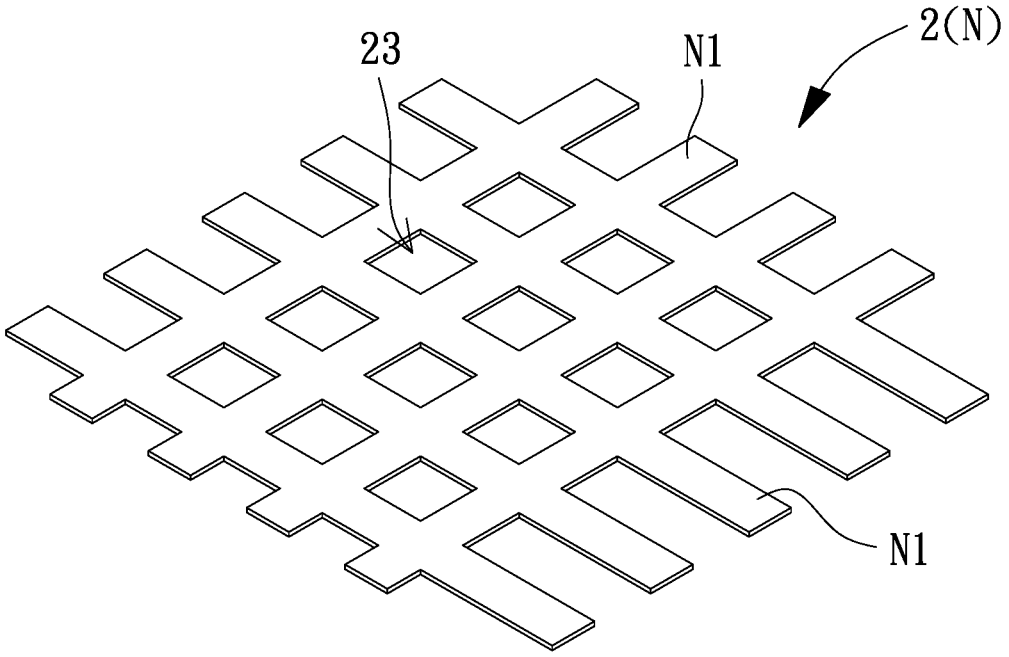
FIG. 4 is a diagrammatic view of the capillary structure formed of a metal net according to the present invention after shaping.
Figure 5:
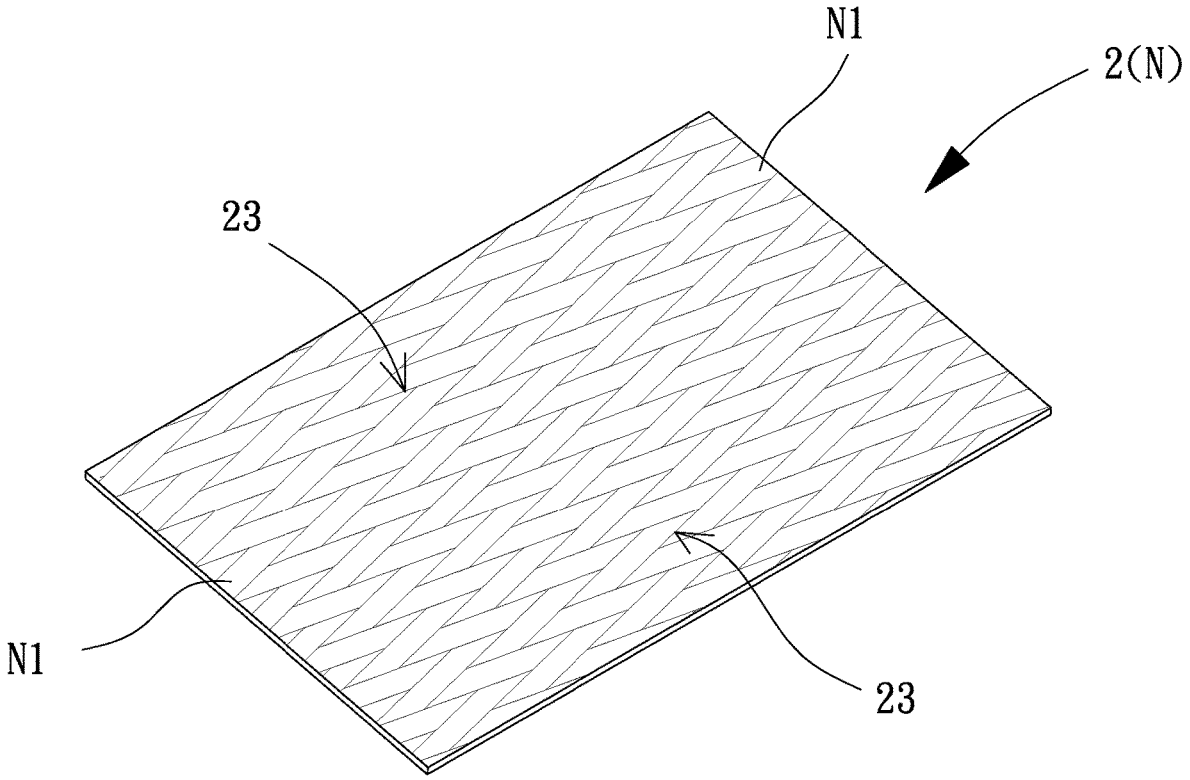
FIG. 5 is a perspective view of a capillary structure formed of a knitted net according to the present invention.

The way for shaping the capillary structure 2 is not limited in the present invention. For example, with reference to FIG. 3, the capillary structure 2 may be a metal net N having a plurality of capillary pores 23. The metal net N may include a plurality of metal wires N1 intersecting each other. As shown in FIG. 4, after shaping the metal net N, the diameter of the capillary pores 23 is reduced due to expansion of the metal wires N1. Thus, the reduced capillary pores 23 can increase the adsorption force of the capillary action. On the other hand, with reference to FIG. 5, the metal net N may be a knitted net formed by knitting a plurality of metal wires N1 in an overlapping pattern. Likewise, the diameter of the capillary pores 23 between the plurality of metal wires N1 can be reduced due to expansion of the plurality of metal wires N1 while generating posts.

Figure 6:
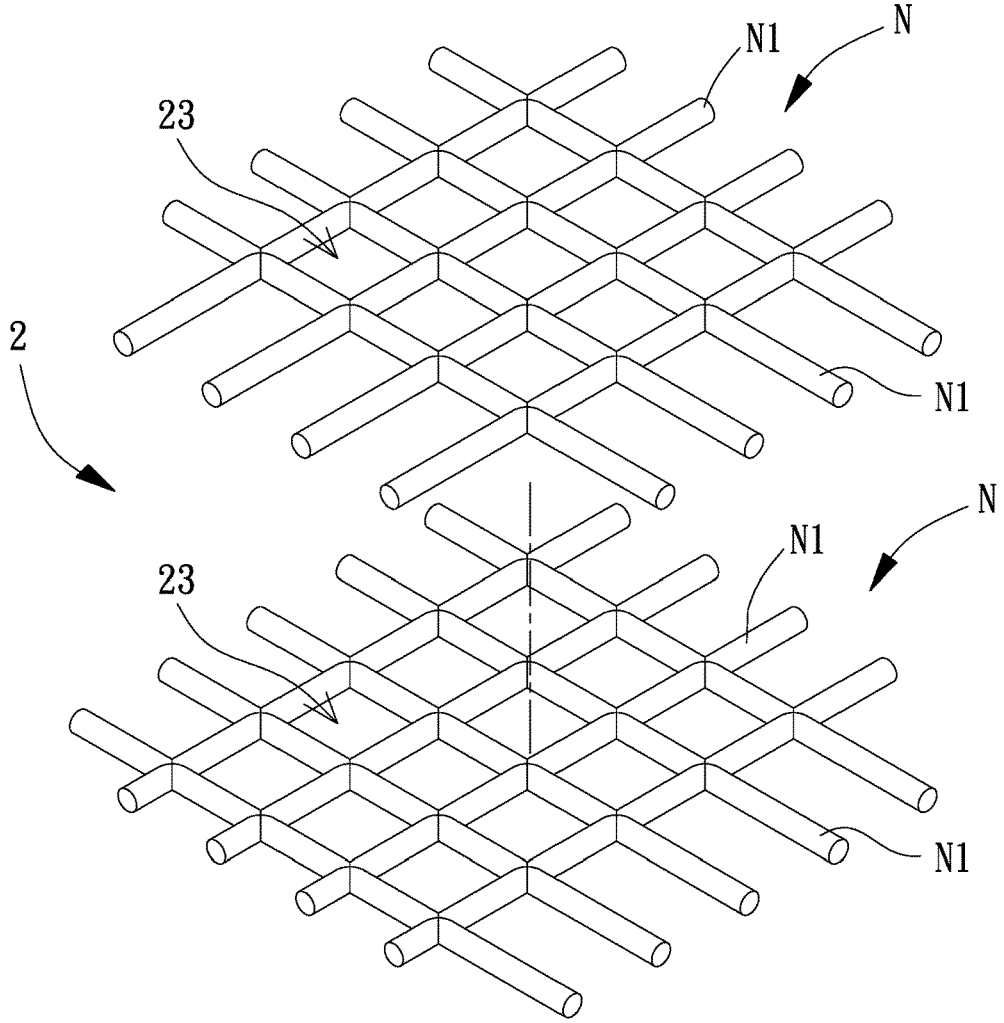
FIG. 6 is an exploded, perspective view of a capillary structure formed of two stacked layers of metal nets according to the present invention.
Figure 7:
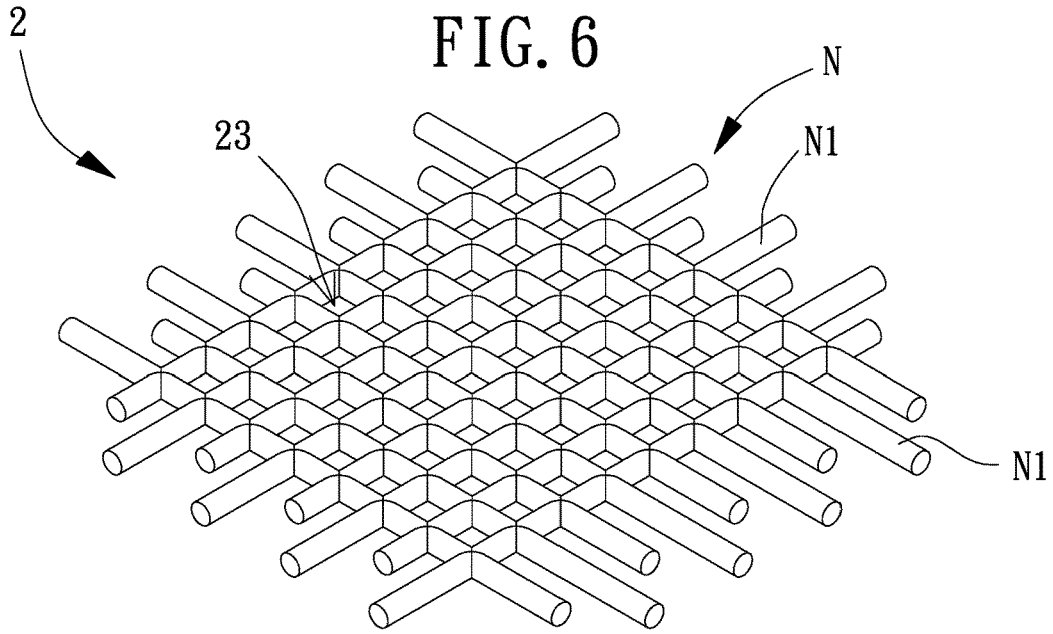
FIG. 7 is a perspective view of the capillary structure formed of two stacked layers of metal nets according to the present invention after shaping.

Furthermore, the capillary structure 2 may be formed by stacking a plurality of metal nets N followed by shaping. The meshes of the plurality of metal nets N can be different. For example, metal nets N of 50 meshes and 200 meshes can be used. A metal net N with fewer meshes may have coarser metal wires N1 (namely, having a larger thickness). A metal net N with more meshes may have thinner metal wires N1 (namely, having a smaller thickness). Thus, metal nets with large-diameter wires and metal nets with small-diameter wires can be stacked to achieve the supporting height, thereby saving material. As shown in FIGS. 6 and 7, the capillary structure 2 may be formed of two stacked metal nets N. Specifically, when the two metal nets N are stacked, the metal wires N1 of one of the two metal nets N are aligned with the capillary pores 23 of another metal net N. Next, shaping is carried out, such that the two metal nets N are embedded into each other on opposed faces thereof. Thus, a capillary pore 23 of an initially larger diameter can be divided into plural capillary pores 23 of a smaller diameter.

Figure 8:
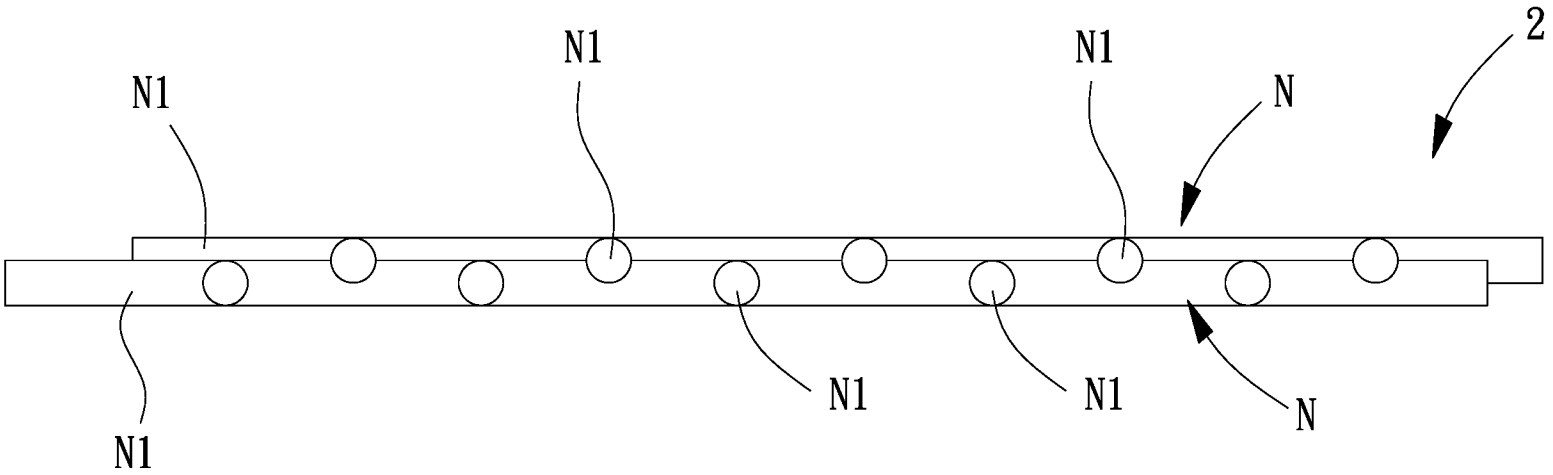
FIG. 8 is diagrammatic view illustrating the capillary structure formed of two layers of metal nets partially embedded in opposite faces thereof.
Figure 9:
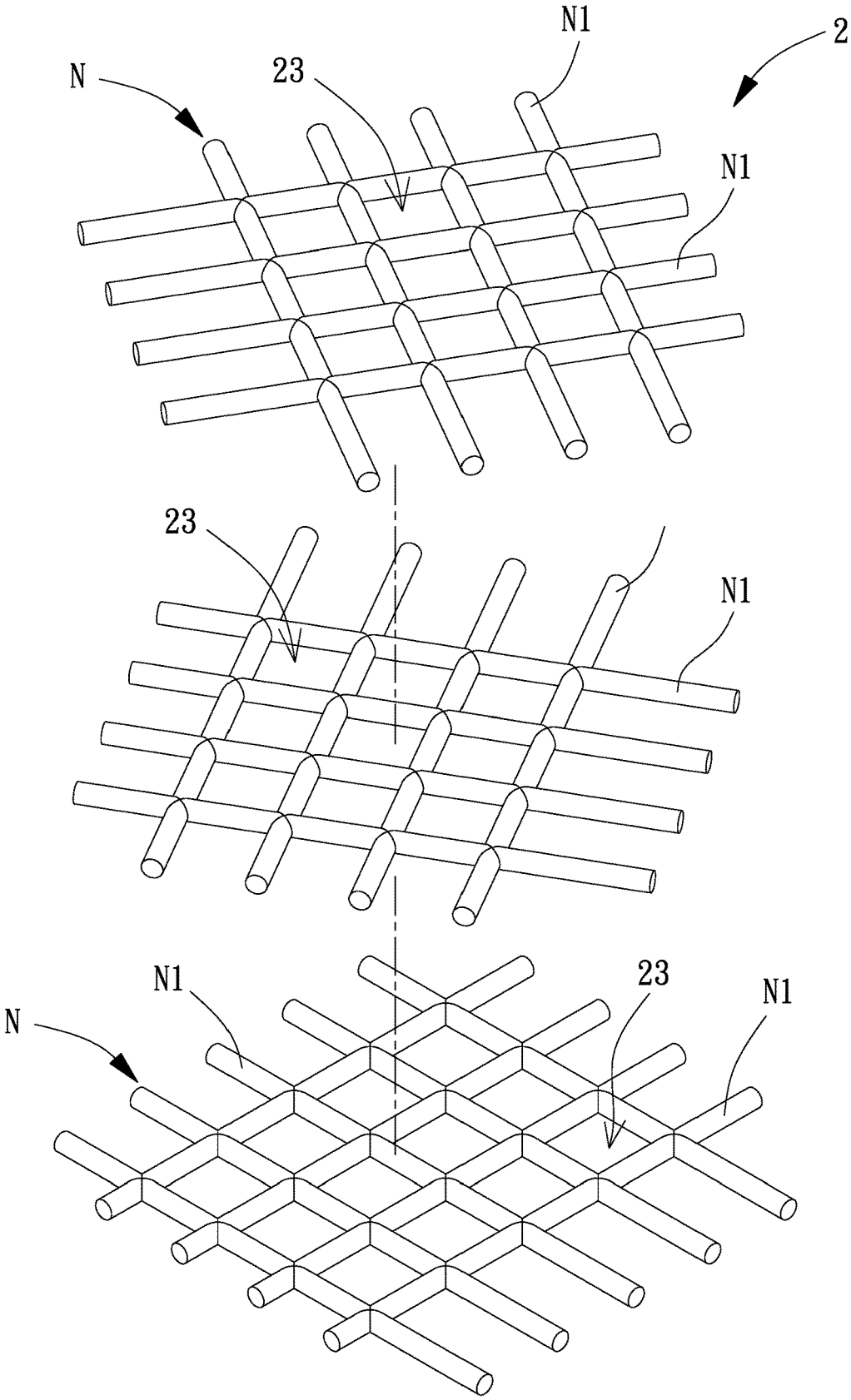
FIG. 9 is an exploded, perspective view of a capillary structure formed of three stacked layers of metal nets according to the present invention.

Furthermore, the capillary structure 2 may include capillary pores 23 of different diameters, and the number of capillary pores 23 per unit area may be increased, thereby increasing the adsorption force of the capillary action. The capillary structure 2 may include a plurality of layers of metal nets N stacked according to product need, such that the diameter of the divided capillary pores 23 can be further divided. Thus, the diameter of the capillary pores 23 can be significantly reduced, and the number of capillary pores 23 can be increased. The embedding includes complete embedding of two metal nets N or partial embedding shown in FIG. 8. Partial embedding makes more and smaller capillary pores 23 only appear in the portions of the capillary structure 2 where the metal nets N are embedded with each other. Namely, the capillary structure 2 may include capillary pores of different numbers and different diameters in the opposite directions of adjacent metal nets N. This also increases the adsorption force of the capillary action and increases the content of the working fluid L per unit area. As mentioned above, the capillary structure 2 may be formed by stacking a plurality of metal nets N followed by shaping. With reference to FIG. 9, in this embodiment, the capillary structure 2 may include three metal nets N which are stacked and are in different angular positions relative to each other. In addition to further increase the number of the capillary pores 23, the shape of the meshes of the capillary structure 2 is no longer limited to square or rhombic obtained by conventional plain weaving, providing densely distributed capillary pores 23 of composite shapes that cannot be achieved by conventional processes.

Figure 10:
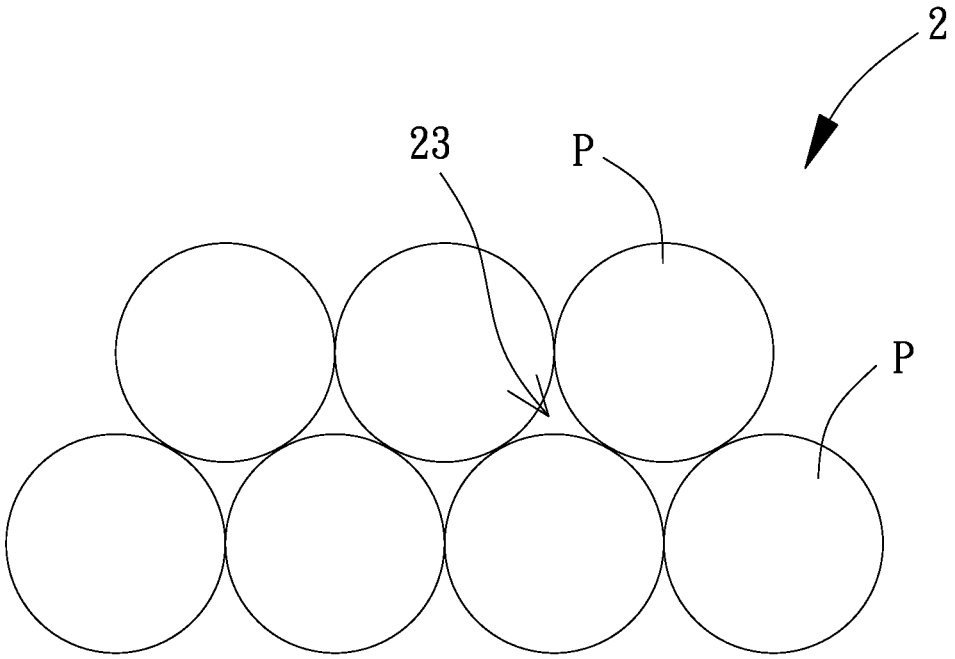
FIG. 10 is a diagrammatic structural view of sintered powders according to the present invention.
Figure 11:
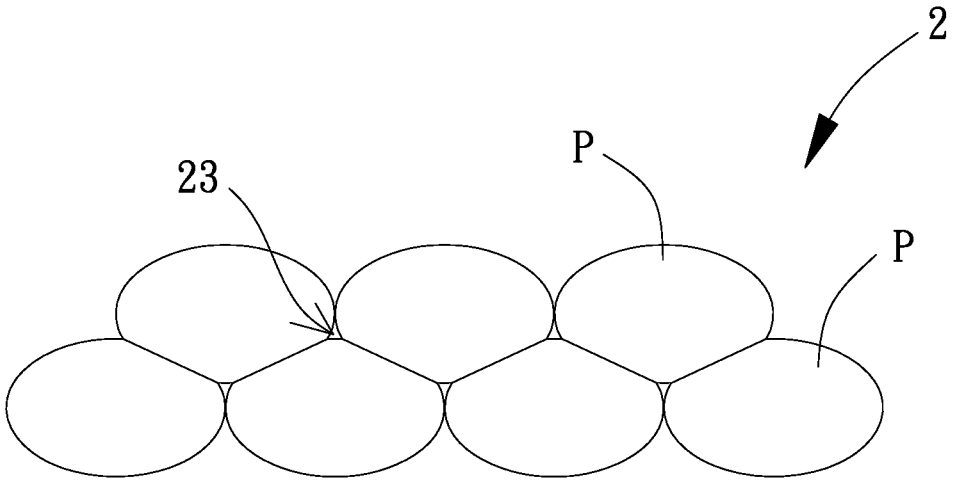
FIG. 11 is a diagrammatic structural view of the sintered powders according to the present invention after shaping.

With reference to FIG. 10, when the capillary structure 2 is a sintered powder structure, the capillary pores 23 of the capillary structure 2 may be formed between plural adjacent powder particles P. After shaping the plural powder particles P, as shown in FIG. 11, these powder particles P can deform and expand. Thus, the diameter of the capillary pores 23 can be reduced to increase the adsorption force of the capillary action while providing the function of posts.

In view of the foregoing, by shaping the capillary structure 2, the diameter of the capillary pores 23 can be smaller than 0.2 mm to generate the adsorption force of capillary action. Specifically, the capillary structure 2 may be a copper net, and the diameter of the capillary pores 23 can be smaller than 0.042 mm after shaping. Alternatively, the capillary structure 2 may be a stainless steel net, and the diameter of the capillary pores 23 can be smaller than 0.03 mm after shaping. In each case, the adsorption force of capillary action is increased while providing the function of posts.

With reference to FIG. 2 again, in use of the vapor chamber J of this embodiment, for example, the first sheet 1*a* of the casing 1 is in thermal connection with a heat generating object, such that the first sheet 1*a* conducts the heat energy of the heat generating object to the lower inner surface F1, and the working fluid L in the chamber S absorbs the heat energy. After absorbing the heat energy, the working fluid L in the chamber S evaporates from the liquid state into the gaseous state. Then, the working fluid L condenses into the liquid state after contacting with the second sheet 1*b* of a relatively lower temperature and gathers again by the capillary structure 2, such that the working fluid L can absorb heat energy from the heat generating object again. This cycle is repeated to achieve excellent cooling effect. The capillary structure 2 can abut the inner wall of the casing 1 by the substrate 21 and the supporting portion 22. The chamber S can be supported by the substrate 21 and the supporting portion 22 to avoid collapse or deformation of the surface of the chamber S due to a normal pressure acting on the surface of the chamber S or a negative pressure resulting from an internal vacuum. At the same time, since the supporting portion 22 provides both supporting and capillary action, the cooling effect can be increased while assisting the heat sink in further replacing the procedure of formation of post by etching. The manufacturing costs are significantly reduced, which is very helpful in miniaturization or thinning of the heat sink.

Figure 12:
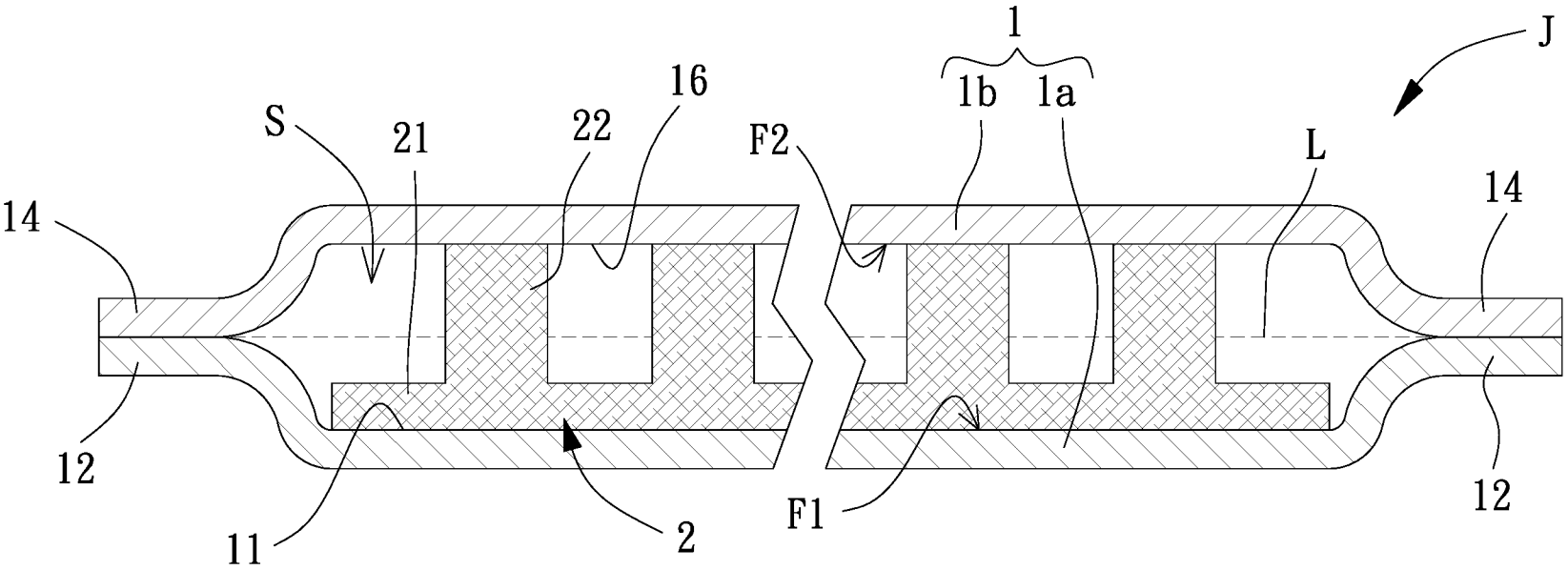
FIG. 12 is a cross sectional view of a heat sink of a second embodiment according to the present invention after assembly.

With reference to FIG. 12 showing a heat sink of a second embodiment according to the present invention, in this embodiment, the second sheet 1*b* also includes a receiving groove 16. Thus, when the second sheet 1*b* is coupled to the first sheet 1*a*, the receiving groove 16 intercommunicates with the receiving groove 11 to jointly form the larger chamber S, which is advantageous to development of the gas-liquid phase conversion, thereby increasing the cooling effect.

Figure 13:
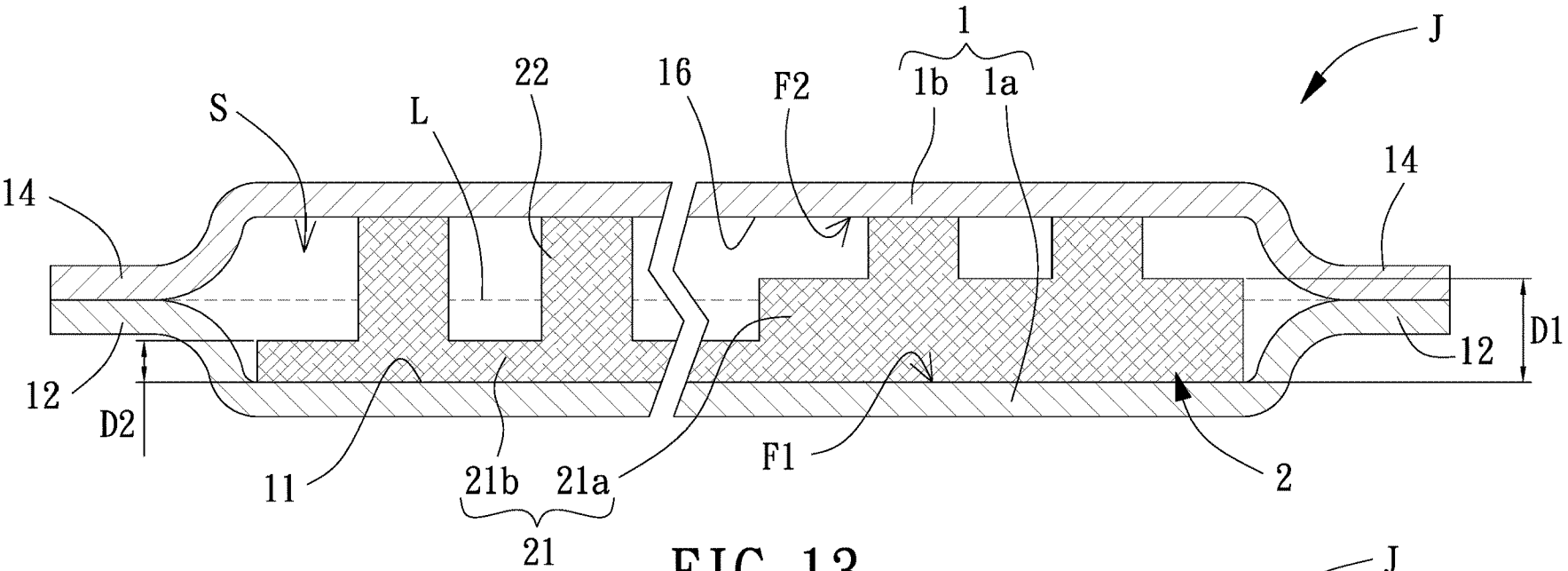
FIG. 13 is a cross sectional view of ta heat sink of a third embodiment according to the present invention after assembly.

With reference to FIG. 13 showing a heat sink of a third embodiment according to the present invention, after shaping the capillary structure 2, the substrate 21 forms at least one first board 21*a* and at least one second board 21*b*. The thickness D1 of the first board 21*a* and the thickness D2 of the second board 21*b* may be different. In this embodiment, the thickness D1 of the first board 21*a* may be larger than the thickness D2 of the second board 21*b*. Namely, the degree of compression may be smaller, such that the first board 21*a* may have capillary pores 23 with a diameter larger than that of the capillary pores 23 of the second board 21*b*. By providing capillary pores 23 of different diameters, the flow rate of the working fluid L can be increased to achieve better cooling effect.

Figure 14:
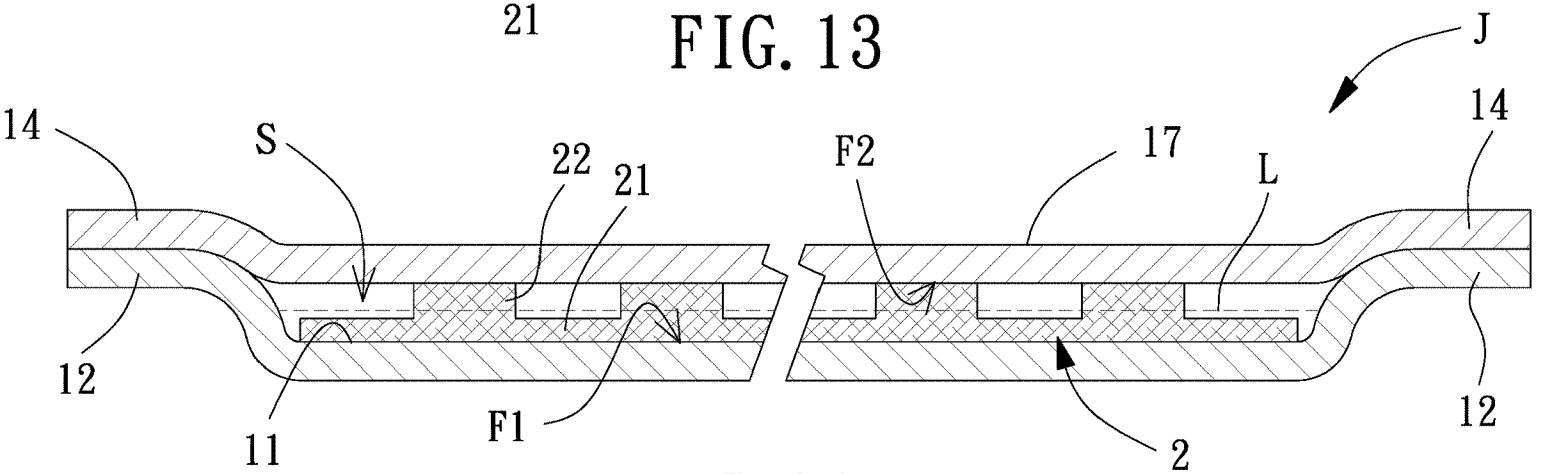
FIG. 14 is a cross sectional view of a heat sink of a fourth embodiment according to the present invention after assembly.

With reference to FIGS. 14-18, the first sheet 1*a* and/or the second sheet 1*b* may be recessed towards the chamber S to reduce the occupied space or to increase the cooling area. With reference to FIG. 14 showing a heat sink of a fourth embodiment according to the present invention, in this embodiment, the second sheet 1*b* includes a recessed portion 17 recessed towards the chamber S. Thus, the recessed portion 17 can serve as an evasive portion for receiving a heat generating object or an electronic element, reducing the space occupied.

Figure 15:
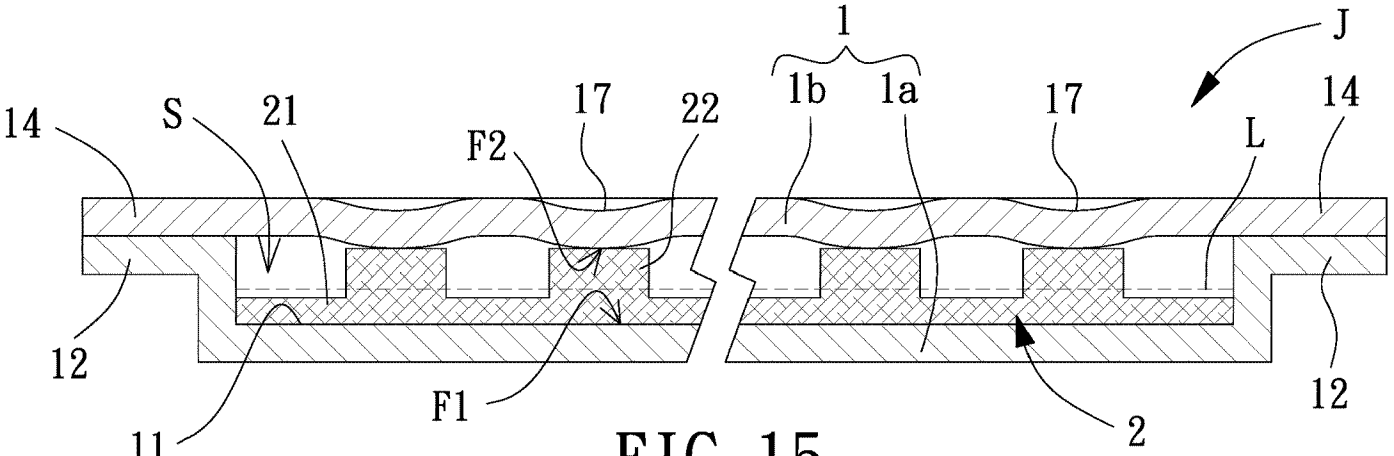
FIG. 15 is a cross sectional view of a heat sink of a fifth embodiment according to the present invention after assembly.

With reference to FIG. 15 showing a heat sink of a fifth embodiment according to the present invention, in comparison with the fourth embodiment, the second sheet 1*b* may include a plurality of recessed portions 17. Each of the plurality of recessed portions 17 may abut a respective supporting portion 22. Thus, the cooling area of the second sheet 1*b* can be increased to achieve better cooling effect while increasing the supporting force.

Figure 16:
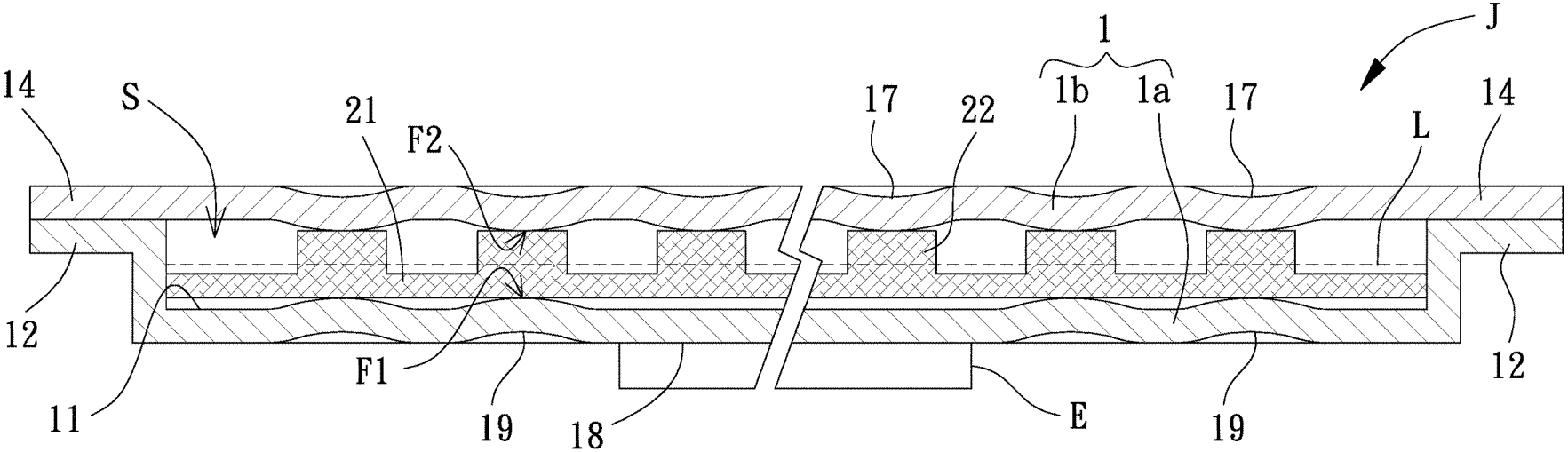
FIG. 16 is a cross sectional view of a heat sink of a sixth embodiment according to the present invention after assembly.

With reference to FIG. 16 showing a heat sink of a sixth embodiment according to the present invention, in comparison with the fifth embodiment, the outer surface 18 of the first sheet 1*a* may include a heat absorbing surface 18. The heat absorbing surface may be connected to a heat generating object E. The portion of the first sheet 1*a* outside of the heat absorbing surface 18 may also include a plurality of recessed portions 19 recessed towards the chamber S. Each of the plurality of recessed portion 19 may abut the substrate 21. Thus, the cooling areas of the first sheet 1*a* and the second sheet 1*b* can be increased simultaneously to achieve better cooling effect.

Figure 17:
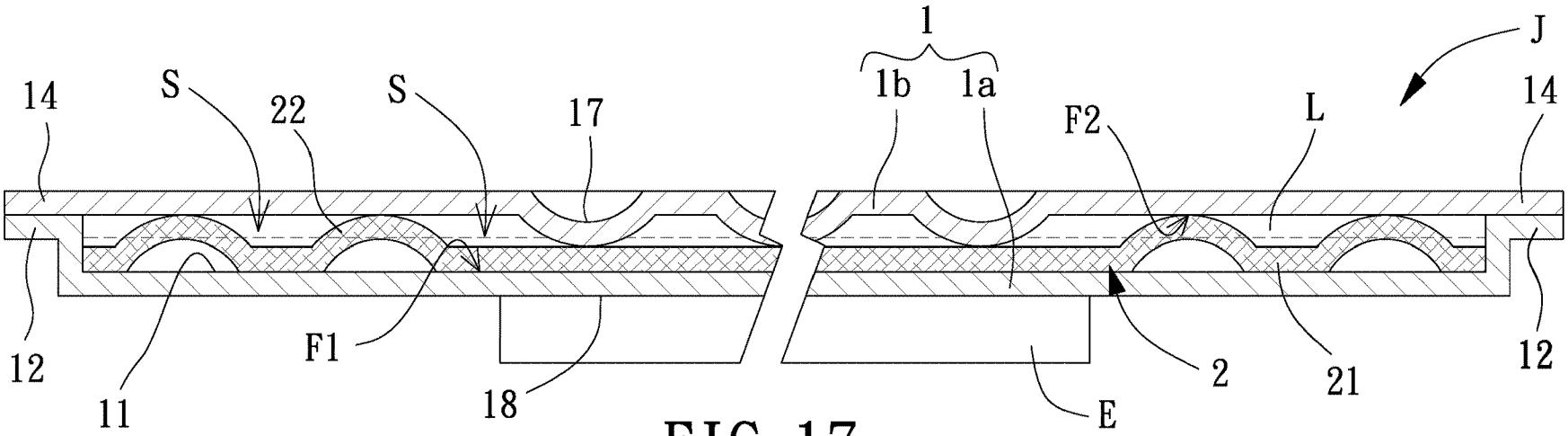
FIG. 17 is a cross sectional view of a heat sink of a seventh embodiment according to the present invention after assembly.

With reference to FIG. 17 showing a heat sink of a seventh embodiment according to the present invention, in this embodiment, the recessed portion 17 and the supporting portion 22 may not abut each other. Thus, the cooperative mechanism provides an evasion to permit easy installation of the heat sink in a limited space.

Figure 18:
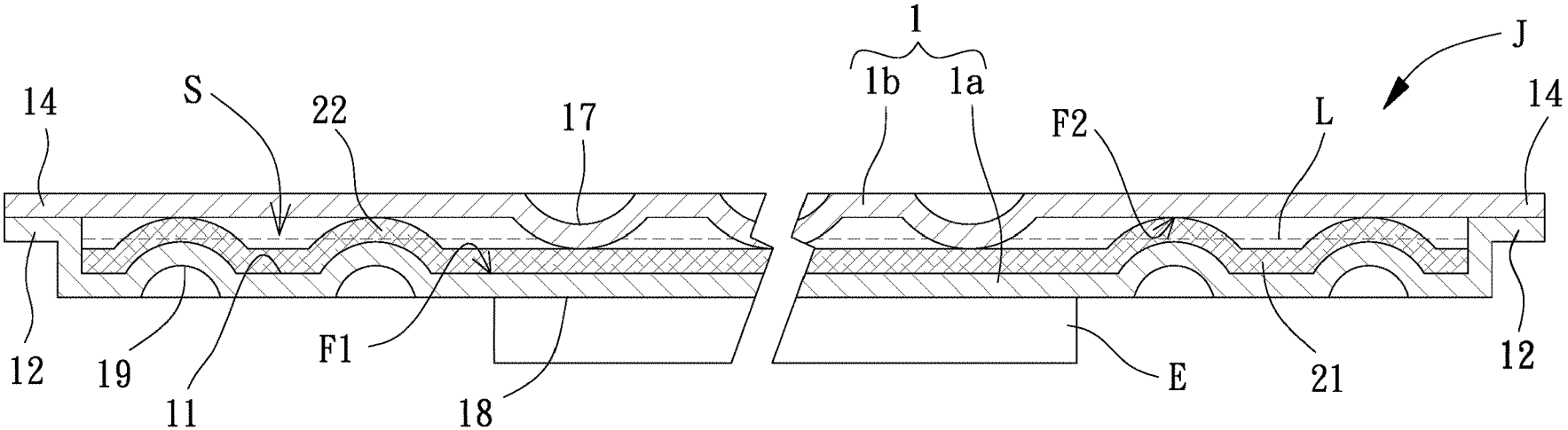
FIG. 18 is a cross sectional view of a heat sink of an eighth embodiment according to the present invention after assembly.

With reference to FIG. 18 showing a heat sink of an eighth embodiment according to the present invention, in comparison with the seventh embodiment, the recessed portion 19 of the first sheet 1*a* makes one of the lower inner surfaces F1 of the casing 1 protrude into the chamber S. When the capillary structure 2 is disposed in the chamber S, the capillary structure 2 may sinuate on the lower inner surface F1 to form the supporting portion 22. Namely, the supporting portion 22 and the recessed portion 19 can be formed simultaneously after shaping to simplify the processing procedure.

Figure 19:
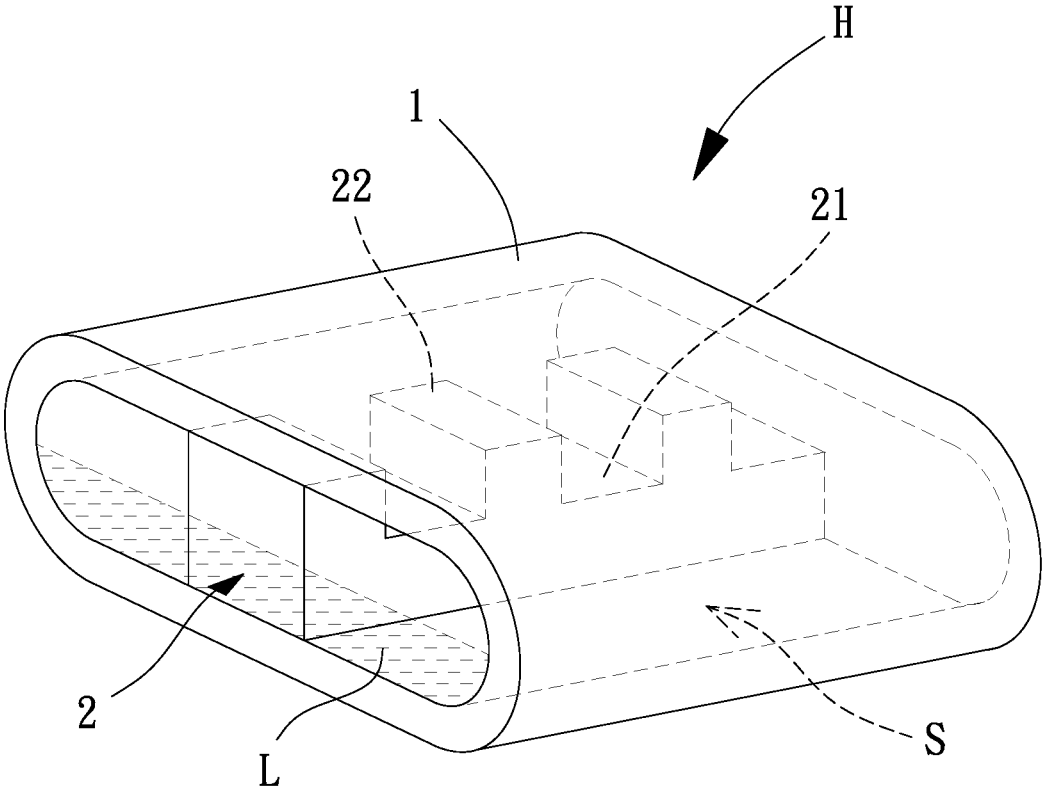
FIG. 19 is a cross sectional view of a heat sink of a ninth embodiment according to the present invention after assembly.

With reference to FIG. 19 showing a heat sink of a ninth embodiment according to the present invention, the heat sink of this embodiment may be a heat pipe H. The casing 1 also includes the chamber S therein for receiving the capillary structure 2 and the working fluid L. The casing 1 and the capillary structure 2 of the heat pipe H of this embodiment may also be arranged to include the configuration of each of the above embodiments according to user need, details of which are not set forth to avoid redundancy.

In view of foregoing, in the heat sink according to the present invention, since the supporting portion are formed after shaping the capillary structure, the steps of placing the posts, welding the posts, or direct etching metal boards to form the posts are not required. Thus, the manufacturing procedures of the heat sink can be simplified, which is more helpful in significantly reducing the manufacturing costs, particularly in the case of replacing posts formed by etching metal sheets. The capillary structure can be formed by shaping to significantly reduce the diameters of the capillary pores and to increase the number of the capillary pores. Thus, the flow rate of the working fluid can be effectively increased to enhance the cooling effect. Since the supporting portion provide both efficacies of supporting and capillary action, the cooling effect can be increased, which is very helpful in miniaturization or thinning of the heat sink. Furthermore, the casing may include the recessed portion to increase the cooling area, further increasing the cooling effect.

Although the present invention has been described with respect to the above preferred embodiments, these embodiments are not intended to restrict the present invention. Various changes and modifications on the above embodiments made by any person skilled in the art without departing from the spirit and scope of the present invention are still within the technical category protected by the present invention. Accordingly, the scope of the present invention should be defined by the appended claims.

What is claimed is:

1. A heat sink comprising:

a casing including a chamber filled with a working fluid; and a capillary structure located in the chamber, wherein the capillary structure is formed by stacking a plurality of metal nets and then shaping the plurality of metal nets, metal wires of one of the two metal nets are aligned with capillary pores in another of the two metal nets when two metal nets are stacked, then the two metal nets are embedded into each other after shaping, so that the capillary structure includes a plurality of capillary pores of different diameters and at least one supporting portion connected to a substrate, and the substrate and the at least one supporting portion abut two opposite inner faces of the casing, respectively.

2. The heat sink as claimed in claim 1, wherein the capillary structure includes capillary pores of a diameter smaller than 0.2 mm.

3. The heat sink as claimed in claim 1, wherein the capillary structure is shaped by punching or rolling to form the substrate and the at least one supporting portion which are integrally connected to each other.

4. The heat sink as claimed in claim 1, wherein an average diameter of capillary pores in the substrate is smaller than an average diameter of capillary pores in the at least one supporting portion.

5. The heat sink as claimed in claim 1, wherein the capillary pores in the at least one supporting portion is larger than 0.2 mm.

6. The heat sink as claimed in claim 1, wherein the plurality of metal nets has different meshes and different thicknesses.

7. The heat sink as claimed in claim 1, wherein the plurality of metal nets is stacked and is in different angular positions relative to each other.

8. The heat sink as claimed in claim 1, wherein the substrate includes a first board and a second board having a thickness different from a thickness of the first board.

9. The heat sink as claimed in claim 1, wherein the casing includes at least one recessed portion recessed towards the cavity.

10. The heat sink as claimed in claim 9, wherein the at least one recessed portion abuts the at least one supporting portion.

11. The heat sink as claimed in claim 9, wherein the at least one recessed portion and the at least one supporting portion do not abut each other.

12. The heat sink as claimed in claim 9, wherein the at least one recessed portion makes one of the two opposite inner faces of the casing protrude into the chamber, and wherein the capillary structure sinuates on the one of the two opposite inner faces to form the at least one supporting portion.

13. The heat sink as claimed in claim 1, wherein the plurality of metal wires of the capillary structure becomes flat after shaping.

* * * * *